US005719557A

United States Patent [19]

Rattman et al.

[11] Patent Number: 5,719,557

[45] Date of Patent: Feb. 17, 1998

[54] PHOTOELECTRIC SMOKE DETECTOR

[75] Inventors: William J. Rattman, Orlando, Fla.; Zhexin Mi, Toronto, Canada

[73] Assignee: Digital Security Controls Ltd., Downsview, Canada

[21] Appl. No.: 627,509

[22] Filed: Apr. 5, 1996

Related U.S. Application Data

[63] Continuation of Ser. No. 246,144, May 19, 1994.

[51] Int. Cl.[6] ..... G08B 17/10

[52] U.S. Cl. ..... 340/628; 340/630; 250/573; 250/574; 356/339

[58] Field of Search ..... 340/628, 630, 340/693; 250/573, 574; 356/338, 339

[56] References Cited

U.S. PATENT DOCUMENTS

| | | | |
|---|---|---|---|
| 3,799,670 | 3/1974 | Kohr | 356/207 |
| 4,242,673 | 12/1980 | Cooper | 340/630 |
| 4,315,158 | 2/1982 | Kakigi et al. | 250/574 |

*Primary Examiner*—Jeffery Hofsass
*Assistant Examiner*—Julie B. Lieu

[57] ABSTRACT

The present invention provides for a smoke detection chamber and a photoelectric smoke detector containing the smoke detection chamber. The smoke detection chamber has side walls with openings provided therein for ingress and egress of smoke particles, a top and a bottom. A photoemitting diode is mounted in a mounting arrangement in the side wall of the smoke detection chamber to transmit a light beam across the smoke detection chamber without directly impinging upon either the top or the bottom surfaces. The bottom of the smoke detection chamber has an opening with a shielding arrangement thereabout open to the chamber located between the centerline of the smoke detection chamber and the mounting arrangement in the side wall of the chamber. A photodiode detector is positioned generally in the opening so that it views into the smoke detection chamber through the opening and shielding arrangement, the shielding arrangement shielding the photodiode detector from incident light which may be present in the smoke detector chamber while providing for a diverging field of view of the photodiode detector. The intersection of the field of view of the photodiode detector and the light beam of the photoemitting diode defines a detection volume contained within the smoke detection chamber located close to the photoemitting diode and the photodiode detector and spaced from the surfaces of the smoke detection chamber.

24 Claims, 2 Drawing Sheets

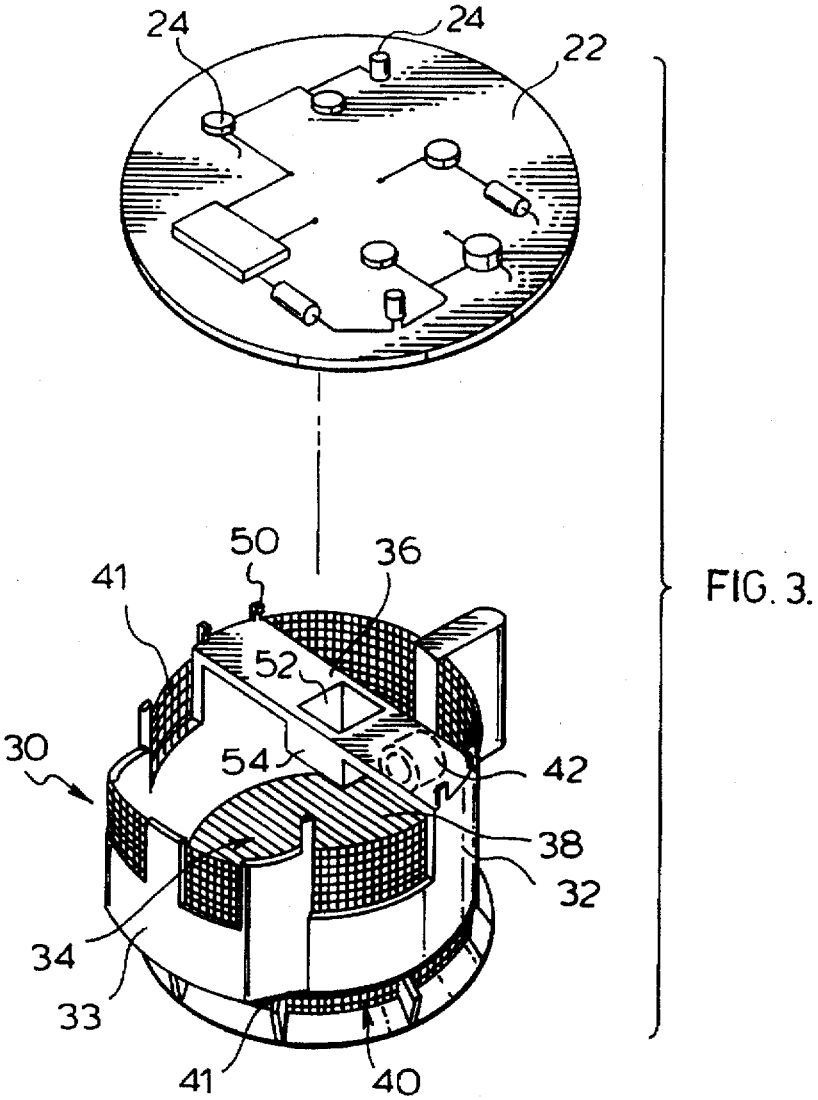
FIG. 3.
FIG. 4.
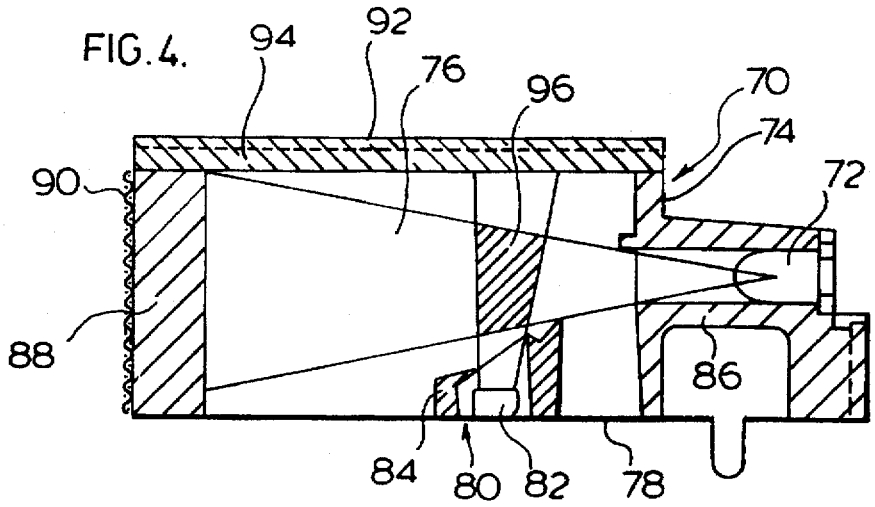

PHOTOELECTRIC SMOKE DETECTOR

This application is a continuation of application Ser. No. 08/246,114 now abandoned.

FIELD OF THE INVENTION

The present invention relates to a light scattering type photoelectric smoke detector, more particularly, a light scattering photoelectric smoke detector having a surface mounted photodiode detector oriented to a photoemitting diode to provide for good sensitivity and radio frequency interference immunity.

BACKGROUND OF THE INVENTION

Smoke detectors based on light scattering by smoke particles have been known for a number of years. Such detectors at present utilize solid state components including photoemitting diodes and photodiode detectors, the two devices being incorporated in a fixed mounted arrangement within a smoke sensing chamber. The smoke sensing chamber is generally designed to exclude most ambient light influences while providing openings to permit entry of the smoke particles into the sensing chamber. There have been many such designs developed and patented which rely upon the walls of the smoke chamber having labyrinth designs to allow the passage of the smoke particles while excluding ambient light from the interior of the chamber. Examples of such designs are shown in U.S. Pat. Nos. 3,914,616, 4,168,438, 4,315,158, 4,672,217 and 4,851,819. In many of the chambers of the above noted patents, the photoemitting diodes and photodiode detectors are mounted in either the sides of the chamber or on the bottom of the chamber, most typically with a 60 degree scattering angle along a horizontal plane between the photoemitting diodes and photodiode detectors. The design of many of the prior art smoke detection chambers results in a generally horizontal flow of the smoke particles through the chamber. Ideally, the photoemitting diode and photodiode detector should be mounted in such a way that the intersection of the transmitted light from the photoemitting diode and the view of the photodiode detector falls within the horizontal path of the smoke particles. However, depending upon the laminar flow rate of the smoke particles through the chamber, the horizontal flow may be shifted from the intersection thereby affecting the sensitivity of the smoke detector. Also, the use of the 60° scattering angle increases the distance between the photodiode detector and photoemitting diode thereby affecting the sensitivity and increasing the potential for dust particle interference. In addition, many of the prior art mounting arrangements generally require the use of leads between the photodiode detector and/or the photoemitting diode and the printed circuit board carrying the other electrical and electronic components utilized in the detection and alarm circuitry. The use of such leads increases the potential susceptibility of the alarm units to radio frequency interference (RFI) with exposure to the increased number of radio frequency (RF) transmitters throughout the RF spectrum presently in use. As a result, there has been an increasing need to improve the designs to increase the immunity to radio frequency interference (RFI) to prevent unwanted false alarms. One means of achieving increased RFI immunity has been through the use of leadless, surface mounted components to improve RFI immunity over the older leaded designs. One example of such design is shown in Nagaoka, U.S. Pat. No. 5,138,302, in which the photodetecting element is mounted directly on the printed circuit board and provided with a prism element to focus the scattered light on to the photodetecting element.

Smoke is generally classified as black or grey. Grey smoke particles are generally much easier to detect as they tend to scatter the light from the photoemitting diode very well. Hence, most designs of photoelectric smoke detectors are reasonably effective at detecting grey smoke. Black smoke particles, on the other hand, do not generally scatter the light as well and many designs of photoelectric smoke detectors have difficulty properly detecting the presence and level of black smoke. This is particularly the case with those detectors utilizing a 60° scattering angle as, at this angle, the grey smoke to black smoke sensitivity is only 4:1. In these detectors which are usually set to detect grey smoke at about 3% per foot obscuration, the level of black smoke required to indicate an alarm state would be 12% per foot obscuration or higher. Thus, there still exists a need to provide very sensitive smoke detection of both black and grey smoke particles with minimal radio frequency interference.

SUMMARY OF THE INVENTION

The present invention provides for a photoelectric smoke detector comprising a case having mounted therein a circuit board and a smoke detection chamber. The smoke detection chamber has side walls with openings provided therein for ingress and egress of smoke particles, a top and a bottom. A photoemitting diode is mounted in a mounting arrangement in the side wall of the smoke detection chamber so that a light beam from the photoemitting diode is transmitted across the smoke detection chamber without directly impinging upon either the top or the bottom surfaces. The bottom of the smoke detection chamber has an opening therein with a shielding arrangement thereabout open to the chamber, the opening and shielding arrangement being located between the centerline of the smoke detection chamber and the mounting arrangement in the side wall of the chamber. The circuit board is mounted to overlie the bottom surface and includes a photodiode detector mounted directly thereon and positioned generally in the opening so that it views into the smoke detection chamber through the opening and through the shielding arrangement, the shielding arrangement shielding the photodiode detector from incident light which may be present in the smoke detector chamber while providing for a diverging field of view of the photodiode detector. The diverging field of view of the photodiode detector intersects the light beam of the photoemitting diode to define a detection volume contained within the smoke detection chamber located close to the photoemitting diode and the photodiode detector and spaced from the surfaces of the smoke detection chamber to minimize the effect on the photodiode detector of light from the photoemitting diode which is reflected exterior to the detection volume.

In an aspect of the invention there is provided a smoke detection chamber for use in a photoelectric smoke detector. The smoke detection chamber comprises a side wall band encircling a detection volume to the interior thereof, a top and a bottom spaced from the side wall band to provide for open region for ingress and egress of smoke particles to and from the detection volume. The smoke detection chamber further includes a mounting arrangement for a photoemitting diode located in the side wall band of the smoke detection chamber so that a light beam from such photoemitting diode may be transmitted across the smoke detection chamber without directly impinging upon either the top or the bottom. The bottom of the smoke detection chamber has an opening therein with a shielding arrangement thereabout open to the chamber for mounting of a photodiode detector so that it may view the detection volume through the opening and through the shielding arrangement. The opening and shielding arrangement are located between the centerline of the smoke detection chamber and the mounting arrangement in the side wall of the chamber. The shielding arrangement is capable of shielding a photodiode detector from incident light which may be present in the smoke detector chamber while providing for a diverging field of view of such photodiode detector. The intersection of the centerlines of the mounting arrangement and the shielding arrangement define the detection volume contained within the smoke detection chamber located close to the mounting arrangement and the shielding arrangement and spaced from the surfaces of the smoke detection chamber to minimize the impingement of light reflected exterior to the detection volume on a photodiode detector contained within the shielding arrangement.

In yet another aspect of the invention there is provided a smoke detection chamber for use in a photoelectric smoke detector. The smoke detection chamber comprises side walls with openings provided therein for ingress and egress of smoke particles, a top and a bottom. A mounting arrangement for a photoemitting diode is located in the side wall of the smoke detection chamber so that a light beam from a photoemitting diode may be transmitted across the smoke detection chamber without directly impinging upon either the top or the bottom surfaces. The bottom of the smoke detection chamber has an opening therein with a shielding arrangement thereabout open to the chamber for mounting of a photodiode detector so that it may view into the smoke detection chamber through the opening and through the shielding arrangement. The opening and shielding arrangement are located between the centerline of the smoke detection chamber and the mounting arrangement in the side wall of the chamber. The shielding arrangement is capable of shielding a photodiode detector from incident light which may be present in the smoke detector chamber while providing for a diverging field of view of such photodiode detector. The intersection of the centerlines of the mounting arrangement and the shielding arrangement define a detection volume contained within the smoke detection chamber located close to the mounting arrangement and the shielding arrangement and spaced from the surfaces of the smoke detection chamber to minimize the impingement of light reflected exterior to said detection volume on a photodiode detector contained within the shielding arrangement.

BRIEF DESCRIPTION OF THE DRAWINGS

The above as well as other advantages and features of the present invention will be described in greater detail according to a preferred embodiment of the present invention in which:

FIG. 3 is a exploded perspective view of the smoke chamber and printed circuit board of the smoke alarm of FIG. 1; and FIG. 4 is a side view in cross section of a second embodiment of a smoke detection chamber according to the present invention.

DETAILED DESCRIPTION OF THE PREFERRED EMBODIMENTS

Figure 1:
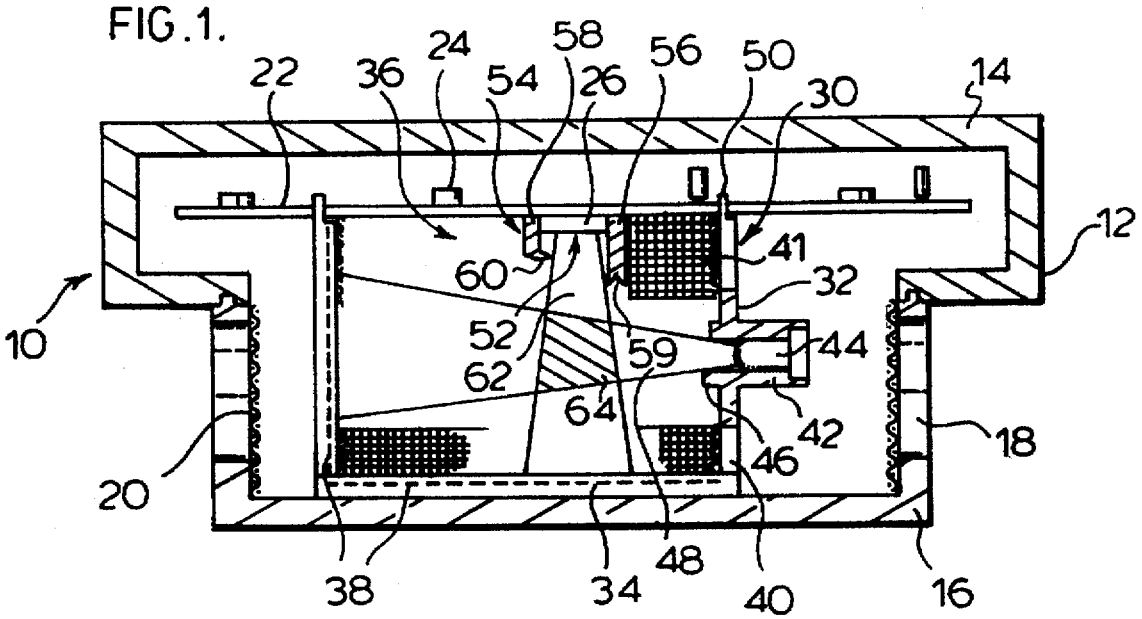
FIG. 1 is a side view in cross section of a preferred embodiment of the smoke detector according to the present invention.
Figure 2:
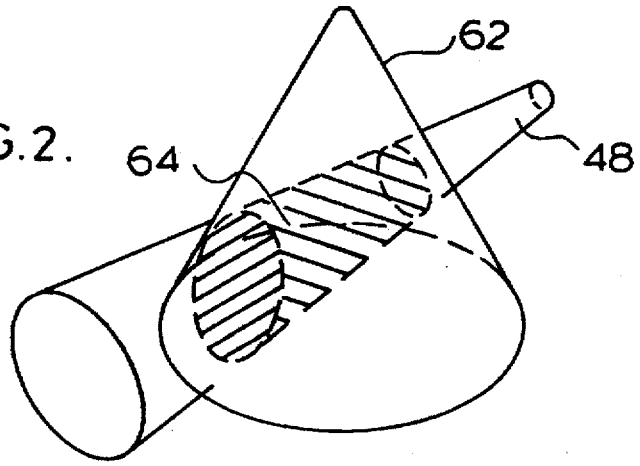
FIG. 2 is a illustration of the intersection of the fields of view of the photodiode detector and photoemitting diode.

A first preferred embodiment of the smoke detector of the present invention is illustrated in FIG. 1 generally indicated by the numeral 10. The smoke detector 10 is a ceiling or wall mountable unit having a case 12 of extruded polymeric material. The case has a base 14 to which is releasably attached a cover 16 having openings 18 to permit entry of smoke into the interior of the case 12. Openings 18 are provided with a fine mesh screen 20 to prevent entry of insects and other large particulate matter into the interior of the case 12.

Mounted within the case 12 in the base 14 is a printed circuit board 22. The printed circuit board has electronic components 24 which typically make up the smoke alarm circuitry mounted to one or both sides of the printed circuit board. Preferably electronic components 24 are surface mounted components. The details of the alarm circuitry are not shown as the design of such circuitry is within the knowledge of ordinary workers in the art of smoke alarm design. Mounted on the printed circuit board 22 is a photodiode detector 26 and a smoke detection chamber 30. The photodiode detector 26 is mounted such that the it views into the smoke detection chamber 30 as will be described further below.

The first preferred embodiment of the smoke detection chamber 30 illustrated in FIGS. 1 and 3, is in the form of a cylinder preferably having an internal diameter between about 2 to 3 inches, however other shapes are possible. As shown in FIGS. 1 and 3, the smoke detection chamber has side walls 32, a top 34 and a bottom 36. As will be appreciated, when the smoke detection chamber 30 is mounted in the case 12 and the case 12 in turn mounted on the ceiling, the bottom 36 of the chamber 30 will in fact form the upper surface of the chamber, while the top 34 of the chamber 30 will form the lower surface. However for ease of understanding, these parts are named in relation to their attachment to the circuit board 22.

The smoke detection chamber 30 may be molded in more than one piece depending upon the complexity of the structures contained therein. For example, the side 32 and bottom 36 may be molded in one piece and the top 34 may be molded as a separate piece which may be releasably attached to the other section of the smoke chamber 30.

To reduce the possibility of reflected light from decreasing the sensitivity of the smoke detector 10, the smoke detection chamber 30 is constructed of a dark colored plastic, usually a black plastic preferably having a matte or flat finish. A particularly preferred material for the smoke detection chamber 30 is black ABS plastic.

The sidewall 32 of smoke detection chamber 30 is provided with openings 40 for ingress and egress of smoke particles into the smoke detection chamber 30. As illustrated in FIG. 3, openings 40 are preferably provided at the periphery of the sidewall 32 adjacent both the top 34 and bottom 36. The openings 40 are clear in that they do not have any obstructions for the free flow of smoke particles such as labyrinths or the like and are provided with a fine mess screen 41 to reduce the entry of insects and large particulate matter into the smoke chamber 30 while allowing passage of smoke particles into the chamber.

Smoke detection chamber 30 in the sidewall 32 is also provided with a mounting arrangement 42 for a photoemitting diode 44. Mounting arrangement 42 has extending walls 46 to provide a tunnel within which is mounted the photoemitting diode 44. Extending walls 46 preferably extend beyond the end of the photoemitting diode 44 to bound or limit the outer rays of the beam of light 48 emitted by the photoemitting diode 44 to provide for a relatively narrow beam of light broadcasting across the smoke chamber 30.

The mounting arrangement preferably restricts the light beam of the photoemitting diode 44 so that the beam only impinges upon the opposite sidewall 33 and not on either the top 34 or bottom 36. These extending walls 46 also provide for shielding of the light beam 48 of the photoemitting diode 44 to reduce the possibility of stray light from the photoemitting diode 44 shining directly onto the photodiode detector 26.

To further reduce the possibility of reflection of light within the chamber 30, the smoke detection chamber 30 is preferably provided with reticulated structures 38 in the sidewall 33 directly opposite the photoemitting diode 44 as well as on the top 34. These reticulated areas 38 of the smoke detection chamber 30 reduce the possibility of reflection of light from the wall 33 and the top 34 and in addition provide an area where any dust which may enter the smoke detection chamber 30 may collect without causing scattering of light to reflect and impinge upon the photodiode detector 26. These dust hiding areas are located such that they are not both in the path of the light beam from the photoemitting diode and also within the view of a photodiode detector as described herein below. While these areas may in one or the other of these locations, they are not located so as to satisfy both conditions.

The smoke detection chamber 30 is preferably mounted directly on the printed circuit board 22 by means of mounting clips 50 inserted through openings provided in the printed circuit board 22.

The bottom 36 of the smoke detection chamber is provided with an opening 52 having a shielding arrangement 54 to overlay the photodiode detector 26 mounted on the printed circuit board 22. The shielding arrangement 54 is of a shape to reduce the possibility of incident light falling onto the photodiode detector 26. The shielding arrangement 54 may be of any suitable shape, for example a right circular cylinder having openings in the top and right circular cylinder having openings in the top and bottom or a rectangular or square structure with an open top and bottom. In the embodiment illustrated in the figures, the shielding arrangement 54 is a square shaped structure having an open top and bottom. The wall 56 of the shielding arrangement closest to the position of the photoemitting diode 44 is of a height to prevent any stray incident light from the photoemitting diode 44 from falling directly on the photodiode detector 26. This wall 56 may be provided with a reticulated groove 59 for holding any dust particles which may come in contact with the shielding arrangement 54 and hiding such dust particles from the field of view of the photodiode detector 26. The opposite wall 58 has a height or shape to prevent any incident light which may enter the chamber 30 through the openings 40 for ingress and egress of smoke particles from falling on the photodiode detector 26. Wall 58 may also be provided with an inclined portion 60 to provide for increased shielding of the photodiode detector 26 from any incident light which may enter the smoke chamber 30.

The photodiode detector 26 contained within the shielding arrangement 54 has a field of view 62 which intersects the light beam 48 of the photoemitting diode 44 generally perpendicularly in a vertical plane to provide for the detection volume to be located within the smoke detection chamber 30 close to both the photoemitting diode 44 and photodiode detector 26 yet spaced from the surfaces of the smoke detection chamber 30 to minimize the effect on the photodiode detector 26 of light from the photoemitting diode 44 which is reflected exterior to the detection volume. The arrangement of the photoemitting diode 44 and photodiode detector 26 with a scattering angle at a generally right angle in the vertical plane permits the detection volume 64 to be located close to the photoemitting diode 44 where the intensity of the light beam from the photoemitting diode 44 is higher and close to the photodiode detector 26 where its sensitivity is higher thereby increasing the overall sensitivity of the smoke alarm 10. In addition the use of the scattering angle at a generally right angle results in a black smoke to grey smoke sensitivity ratio of about 3.5:1, increasing the sensitivity to the presence of smoke particles of many colors, particularly black smoke particles.

To achieve the above, the shielding arrangement 54 is preferably located such that its centerline is between the centerline of the smoke detection chamber 30 and the mounting arrangement 42. Preferably the shielding arrangement is located such that its centerline is located approximately 20% to 40% of the dimension of the smoke chamber 30 away from the mounting arrangement, more preferably approximately 25% to 35%, most preferably approximately 30%. This location is possible because of the use of the scattering angle at a generally right angle and places the photodiode detector 26 close to the photoemitting diode 44 to view the tightly bunched rays and far away from the opposite end wall 33 to reduce the possibility of reflected light falling on the photodiode detector 26. The combination of the location of the shielding arrangement 54 with the mounting of the photodiode detector 26 on the circuit board 22 and the location of photoemitting diode 44 in the sidewall 32 provides for a very broad field of view 62 of the photodiode detector 26 and hence increased sensitivity without having to resort to the provision of additional optical elements such as lenses for focusing of the light. This expanded field of view 62 of the photodiode detector 26 provides for a large area of intersection 64 with the light beam 48 of the photoemitting diode 44 to define the detection volume.

In operation, when smoke particles enter the smoke detector 10 through the openings 18 provided in the cover 16 and then through the openings 38 and 40 provided in the wall 32 of the smoke detection chamber 30, the smoke particles fall within the light beam 48 of the photoemitting diode 44. Smoke particles which are present in the detection volume defined by the area of intersection 64 of the light beam 48 from the photoemitting diode 44 and the field of view 62 of the photodiode detector 26, cause the light from the photoemitting diode 44 to be scattered such that it is directed through the shielding arrangement 54 and on to the photodiode detector 26. When the amount of light detected by the photodiode detector 26 passes a predetermined threshold the smoke alarm circuitry is activated and the detector indicates the alarm condition in the usual manner.

A second embodiment of a smoke detection chamber of the present invention is illustrated in FIG. 4 generally indicated by the numeral 70. The smoke detection chamber 70 is generally rectangular in shape having dimensions of about 1 inch by 1 inch by 2 inches, with the photoemitting diode 72 mounted in the sidewall 74 such that the light beam 76 from the photoemitting diode 72 is broadcast along the long dimension of the rectangular shape. Similar to the first embodiment, the bottom 78 of the smoke detection chamber 70 is provided with an opening 80 for mounting of a photodiode detector 82 and a shielding arrangement 84 surrounding the opening 80. Similarly, the photoemitting diode 72 is mounted in the sidewall 74 within a mounting arrangement 86 to bound or limit the outer rays of the light beam 76 to provide a relatively narrow beam of light broadcasting across the chamber 70. The sidewall 74 of the chamber 70 opposite the photoemitting diode 72 is made up of a series of vanes or louvres 88 which are open to the outside of the chamber 70. These vanes or louvres 88 both permit easy passage of smoke particles into the interior of the chamber 70 as well as acting to cause the light beam 76 from the photoemitting diode 72 to be reflected to the outside of the chamber 70 as it strikes the sidewall surface rather than back into the chamber 70 as may be the case if the sidewall 74 were solid in this region. Similar to the first embodiment, the chamber 70 is provided with screening 90 around all openings as well as having a top 92 which is provided with a reticulated surface 94 for controlling reflection of light and for holding of any dust particles which may enter the chamber. Other details with respect to the relationship between the location of the various elements, the detection volume 96 and operation are similar to those of the first embodiment.

A prototype smoke detector of the present invention as illustrated in the Figures, has been constructed having a smoke detection chamber 30 as shown in FIG. 3, in which the photoemitting diode 44 and photodiode detector 26 are mounted in the large circular cylinder having an interior diameter in the long direction, i.e. along the beam of light of the photoemitting diode, of 2.45 inches. The photoemitting diode 44 broadcasts across the chamber 30 and the photodiode detector 26 views axially with a 90° scattering angle from its mounting position directly on the printed circuit board 22 with the centerline of the photodiode detector and shielding arrangement being located 0.706 inches away from the sidewall 32 in which the mounting arrangement 42 is located. The prototype utilized a Siemens BPW34FA silicon photodiode, a polysulfone-bodied detector with visible light rejection characteristics. The photoemitting diode utilized was a Siemens SFH484 light emitting diode which operates at a wavelength of 880 nm in the infrared range. The alarm and control circuitry employed a Motorola MC145010 IC chip along with required circuitry for operation. The prototype alarm exhibited a high sensitivity and high RFI immunity to false alarms through the UV spectrum to 1 GHz. The large smoke detection chamber with reticulated walls and top achieved low background reflection with good dust hiding capability. The prototype design of the preferred embodiment of the present invention had a normalized figure of merit (NFM) which is a measure of the smoke detection sensitivity to background reflection ratio greater than unity. This translates to smoke alarm signals being three times greater than the background reflection for alarm point settings of three percent per foot obscuration. This high NFM affords exceptional immunity to false alarms from dust accumulation.

Excellent smoke access to the smoke detection chamber is afforded by the smoke detection chamber having screened openings around its periphery at both the top and the bottom of the cylindrical shape together with baffles to disrupt laminar smoke flow associated with low air velocity and dead air typical of smouldering fire conditions. The smoke detection case is similarly vented around the circular periphery both at the top and the bottom and also utilizes disruptive vanes to turbulate laminar smoke flow. The design of the present invention has smoke detection sensitivities of both low and high air velocity within ten percent of each other thus indicating the detector's excellent smoke entry design and the positioning of the detection volume defined by the intersection of the transmitted light from the photoemitting diode and the view of the photodiode detector.

The provision of the surface mounted photodiode detector allows the detector to be mounted directly to the printed circuit board along with the other surface mounted devices in a single step, thus reducing manufacturing costs. The surface mounted photodiode detector is able to view downwards through the opening 52 of the smoke detection chamber 30 directly at the smoke reaction volume. This smoke reaction volume is located in the lower portion of the smoke sensing chamber immediately accessible to the smoke flow.

The smoke detector of the present invention improves alarm response consistency and reduces manufacturing steps and costs. The design of the smoke detector as described herein provides for a very uniform detection sensitivity for various smoke types and colors under varying conditions with high RFI immunity. To further increase the RFI immunity of the smoke detector, the photodiode detector may be mounted on the side of the circuit board opposite the smoke chamber along with the other SMT components. In this situation an aperture may be provided in the circuit board between the photodiode detector and the opening in the bottom of the smoke detection chamber such that the photodiode detector views into the smoke chamber through the aperture in the circuit board and the opening in the bottom of the smoke detection chamber.

Although various preferred embodiments of the present invention have been described herein in detail, it will be appreciated by those skilled in the art, that variations may be made thereto without departing from the spirit of the invention or the scope of the appended claims.

We claim:

1. A photoelectric smoke detector comprising:

a case having mounted therein a circuit board and a smoke detection chamber; the smoke detection chamber having side walls with openings provided therein for ingress and egress of smoke particles, a top and a bottom; a photoemitting diode being mounted in a mounting arrangement in the side wall of the smoke detection chamber so that a light beam from the photoemitting diode is transmitted across the smoke detection chamber without directly impinging upon either the top or the bottom surfaces; said bottom of said smoke detection chamber having an opening therein with a shielding arrangement thereabout open to said chamber, said opening and shielding arrangement being entirely located between the vertical centerline of the smoke detection chamber and the mounting arrangement in the side wall of the chamber, said circuit board being mounted to overlie said bottom surface and including a photodiode detector mounted directly thereon and positioned generally in said opening so that it views into the smoke detection chamber through the opening and through said shielding arrangement, the shielding arrangement shielding the photodiode detector from incident light which may be present in the smoke detector chamber while providing for a diverging field of view of the photodiode detector, the diverging filed of view of the photodiode detector intersecting the light beam of the photoemitting diode to define a detection volume contained within the smoke detection chamber located close to the photoemitting diode and the photodiode detector and spaced from the surfaces of the smoke detection chamber to minimize the effect on the photodiode detector of light from the photoemitting diode which is reflected exterior to said detection volume.

2. A photoelectric smoke detector as claimed in claim 1 wherein the photodiode detector and photoemitting diode are mounted to have a generally perpendicular scattering angle of a generally right angle therebetween.

3. A photoelectric smoke detector as claimed in claim 1 wherein the mounting arrangement for the photoemitting diode bounds or limits the outer rays of the light beam transmitted by the photoemitting diode.

4. A photoelectric smoke detector as claimed in claim 3 wherein the mounting arrangement is a tunnel having walls extending beyond the photoemitting diode.

5. A photoelectric smoke detector as claimed in claim 1 wherein the top of the chamber is reticulated to reduce reflection of light and provide a dust hiding area.

6. A photoelectric smoke detector as claimed in claim 1 wherein the shielding arrangement is generally rectangular having upstanding walls to shield the photodiode detector from incident light and the light beam of the photoemitting diode.

7. A photoelectric smoke detector as claimed in claim 1 wherein the openings in the side walls are provided along the periphery adjacent the bottom and the top.

8. A smoke detector as claimed in claim 1 wherein the shielding arrangement is located such that its centerline is located approximately 20% to 40% of the dimension of the smoke detection chamber away from the mounting arrangement.

9. A smoke detection chamber for use in a photoelectric smoke detector comprising:

side walls with openings provided therein for ingress and egress of smoke particles, a top and bottom; a mounting arrangement for a photoemitting diode located in the side wall of the smoke detection chamber so that a light beam from such photoemitting diode may be transmitted across the smoke detection chamber without directly impinging upon either the top or the bottom surfaces; said bottom of said smoke detection chamber having an opening therein with a shielding arrangement thereabout open to said chamber for mounting of a photodiode detector so that it may view into the smoke detection chamber through the opening and through said shielding arrangement, said opening and shielding arrangement being entirely located between the vertical centerline of the smoke detection chamber and the mounting arrangement in the side wall of the chamber, the shielding arrangement being capable of shielding such photodiode detector from incident light which may be present in the smoke detector chamber while providing for a diverging field of view of such photodiode detector, the intersection of the centerlines of the mounting arrangement and the shielding arrangement defining a detection volume contained within the smoke detection chamber located close to the mounting arrangement and the shielding arrangement and spaced from the surfaces of the smoke detection chamber to minimize the impingement of light reflected exterior to said detection volume on such photodiode detector contained within the shielding arrangement.

10. A smoke detector chamber as claimed in claim 9 wherein the shielding arrangement and mounting arrangement are located to provide a scattering angle between such photodiode detector and such photoemitting diode respectively mounted therein of a generally right angle.

11. A smoke detection chamber as claimed in claim 9 wherein the mounting arrangement bounds or limits the outer rays of a beam of light transmitted by a photoemitting diode mounted therein.

12. A smoke detection chamber as claimed in claim 9 wherein the top of the chamber is reticulated to reduce reflection of light and provide a dust hiding area.

13. A smoke detection chamber as claimed in claim 9 wherein the shielding arrangement is generally rectangular having upstanding walls to shield the opening from incident light and the mounting arrangement for a photoemitting diode.

14. A smoke detection chamber as claimed in claim 9 wherein the openings in the side walls are provided along the periphery adjacent the bottom and the top.

15. A smoke detection chamber as claimed in claim 9 wherein the shielding arrangement is located such that its centerline is located approximately 20% to 40% of the dimension of the smoke detection chamber away from the mounting arrangement.

16. A smoke detection chamber for use in a photoelectric smoke detector comprising:

a side wall band encircling a detection volume to the interior thereof, a top and a bottom spaced from the side wall band to provide for open regions for ingress and egress of smoke particles to and from the detection volume; a mounting arrangement for photoemitting diode located in the side wall band of the smoke detection chamber so that a light beam from such photoemitting diode may be transmitted across the smoke detection chamber without directly impinging upon either the top or bottom; said bottom of said smoke detection chamber having an opening therein with a shielding arrangement thereabout open to said chamber for mounting of a photodiode detector so that it may view the detection volume through the opening and through said shielding arrangement, said opening and shielding arrangement being entirely located between the vertical centerline of the smoke detection chamber and the mounting arrangement in the side wall of the chamber, the shielding arrangement being capable of shielding such photodiode detector from incident light which may be present in the smoke detector chamber while providing for a diverging field of view of such photodiode detector, the intersection of the centerlines of the mounting arrangement and the shielding arrangement defining the detection volume contained within the smoke detection chamber located dose to the mounting arrangement and the shielding arrangement and spaced from the surfaces of the smoke detection chamber to minimize the impingement of light reflected exterior to said detection volume on such photodiode detector contained within the shielding arrangement.

17. A smoke detector chamber as claimed in claim 16 wherein the shielding arrangement and mounting arrangement are located to provide a scattering angle between such photodiode detector and such photoemitting diode respectively mounted therein of a generally right angle.

18. A smoke detection chamber as claimed in claim 16 wherein the mounting arrangement bounds or limits the outer rays of a beam of light transmitted by a photoemitting diode mounted therein.

19. A smoke detection chamber as claimed in claim 16 wherein the top of the chamber is reticulated to reduce reflection of light and provide a dust hiding area.

20. A smoke detection chamber as claimed in claim 16 wherein the shielding arrangement is generally rectangular having upstanding walls to shield the opening from incident light and the mounting arrangement for a photoemitting diode.

21. A smoke detection chamber as claimed in claim 16 wherein the openings in the side walls are provided along the periphery adjacent the bottom and the top.

22. A smoke detection chamber as claimed in claim 16 wherein the shielding arrangement is located such that its centerline is located approximately 20% to 40% of the dimension of the smoke detection chamber away from the mounting arrangement.

23. A smoke detection chamber for use in a photoelectric smoke detector comprising:

side walls with openings provided therein for ingress and egress of smoke particles, a top and bottom; a mounting arrangement for a photoemitting diode located in the side wall of the smoke defection chamber so that a light beam from such photoemitting diode may be transmitted across the smoke detection chamber without directly impinging upon either the top or the bottom surfaces; said bottom of said smoke detection chamber having an opening therein with a shielding arrangement thereabout open to said chamber for mounting of a photodiode detector so that it may view into the smoke detection chamber through the opening and through said shielding arrangement, said opening and shielding arrangement being entirely located between the vertical centerline of the smoke detection chamber and the mounting arrangement in the side wall of the chamber, the shielding arrangement being capable of shielding such photodiode detector from incident light which may be present in the smoke detector chamber while providing for a diverging field of view of such photodiode detector, the intersection of the centerlines of the mounting arrangement and the shielding arrangement defining a detection volume contained within the smoke detection chamber located close to the mounting arrangement and the shielding arrangement and spaced from the surfaces of the smoke detection chamber to minimize the impingement of light reflected exterior to said detection volume on such photodiode detector contained within the shielding arrangement.

24. A smoke detector chamber as claimed in claim 23 wherein the shielding arrangement and mounting arrangement are located to provide a scattering angle between such photodiode detector and such photoemitting diode respectively mounted therein of a generally right angle.

* * * * *